United States Patent [19]

Akutsu et al.

[11] Patent Number: 4,468,590

[45] Date of Patent: Aug. 28, 1984

[54] HIGH-PRESSURE SODIUM LAMP

[75] Inventors: Hidezoh Akutsu, Hyogo; Yoshiro Ogata, Osaka, both of Japan

[73] Assignee: Matsushita Electronics Corporation, Osaka, Japan

[21] Appl. No.: 336,172

[22] Filed: Dec. 31, 1981

[30] Foreign Application Priority Data

Jan. 12, 1981 [JP] Japan ..... 56-2806

[51] Int. Cl.[3] ..... H01J 61/22; H01J 61/33

[52] U.S. Cl. ..... 313/573; 313/634; 313/636; 313/638

[58] Field of Search ..... 313/634, 638, 573, 636

[56] References Cited

U.S. PATENT DOCUMENTS 4,035,691 7/1977 Altman et al. ..... 313/642 X

FOREIGN PATENT DOCUMENTS 2401947 7/1974 Fed. Rep. of Germany ..... 313/634
2117554 7/1972 France ..... 313/636
0005492 3/1979 Japan ..... 313/642
0050568 4/1980 Japan ..... 313/634
0050569 4/1980 Japan ..... 313/634

*Primary Examiner*—Palmer C. Demeo
*Attorney, Agent, or Firm*—Burgess, Ryan & Wayne

[57] ABSTRACT

A high-pressure sodium lamp in which the inner diameter of an arc envelope is largest at the midpoint between the ends thereof and the inner and outer diameters thereof in the vicinity of the ends at which are airtightly fitted electrodes and their associated parts are reduced gradually relative to the inner diameter of the midpoint thereof. When the arc envelope is turned on, the following conditions are satisfied:

$T_e \geqq 0.85\ T_c$ and $1020°\ C. \leqq T_c \leqq 1200°\ C.$ where $T_e$ is the wall temperature at the leading or inner tip of each of the electrodes and $T_c$ is the wall temperature at the midpoint of the arc envelope.

3 Claims, 5 Drawing Figures

HIGH-PRESSURE SODIUM LAMP

BACKGROUND OF THE INVENTION

The present invention relates to a high-pressure sodium lamp with high color rendition.

There have been recently devised and demonstrated high-pressure sodium lamps with a high general color rendering index $R_a$ of 65 to 85. Radiation from these lamps are almost equal in color and warmness to incandescent lamps and have by far a higher efficacy and a lamp life than the latter so that they now find wide applications instead of incandescent lamps in various fields.

In general, the high color-rendition, high-pressure sodium lamps of the type described use a straight arc tube whose inner diameter is larger than that of the conventional high-pressure sodium lamp and the operating vapor pressure of sodium filled in the arc tube is raised so that the spectrum covers the whole visible range. However, they have some problems. First of all, radiation at the ends of the arc tube is bluish. Secondly, the starting time is relatively longer.

In order to overcome these and other problems, the inventors disclose in their Japanese Patent Application No. 129780/1980 a high-pressure sodium lamp in which, instead of a straight arc tube, an arc envelope or tube is employed whose inner diameter is largest at the midpoints between the ends and is reduced in the vicinity of both electrodes. This arc envelope is referred to as "an ellipsoidal envelope or tube" in this specification.

The high color-rendition, high-pressure sodium lamps of the types described above which can be used instead of incandescent lamps have a fatal common defect in that their lamp efficacy is considerably low as compared with metal-halide lamps. That is, the conventional lamps with a color temperature of 2500° K. and a wattage of 150, 250 and 400 W exhibit an initial efficacy of about 52, 54 and 58 lm/W (lumens per watt), respectively, which are considerably lower as compared with an efficacy of 70 to 100 lm/W of the metal halide lamps. The same inventors tried to provide high color-rendition, high-pressure sodium lamps of 20 to 70 W which correspond to most popular incandescent lamps of 60 to 200 W, but the lamp efficacy was disappointingly low. For instance, a lamp of 50 W exhibited a lamp efficacy of as low as about 35 lm/W. On the other hand, the inventors found that if an ellipsoidal arc envelope is used, the lamp efficacy can be increased by 3 to 4% as compared with the case when a straight arc tube is used when the average wall loads (to be defined below) are the same. However, in order to provide high color-rendition, high-pressure sodium lamps which are quite satisfactory in practice, the inventors had to make further extensive studies and experiments.

SUMMARY OF THE INVENTION

In view of the above, one of the objects of the present invention is to provide a high color-rendition, high-pressure sodium lamp which employs an ellipsoidal arc envelope and whose design parameters are so selected that a higher lamp efficacy can be attained.

To this end, the present invention provides a high color-rendition, high-pressure sodium lamp in which the inner diameter of the arc envelope is largest at the midpoint between the ends thereof and is reduced in the vicinity of the ends which are fitted with electrodes and their associated parts such as feed-throughs. The lamp embodying the present invention must satisfy the conditions, when it is turned on, that $T_e \geqq 0.85\ T_c$ and $1020°\ C. \leqq T_c \leqq 1200°\ C.$, where $T_c$ (°C.) is the wall temperature at the midpoint of the arc envelope and $T_e$ (°C.) is the wall temperature at the leading tip of each of the electrodes, these wall temperatures $T_c$ and $T_e$ being measured without the arc envelope being supported in an outer envelope.

DETAILED DESCRIPTION OF THE PRIOR ART

Figure 1:
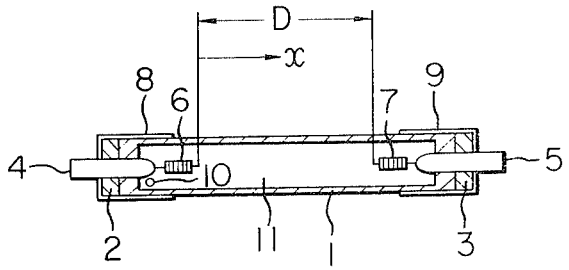
FIG. 1 PRIOR ART
FIG. 1 is a longitudinal sectional view of a prior art high-pressure sodium lamp.

Referring to FIG. 1, reference numeral 1 denotes a straight arc tube made of alumina and fitted with end caps 2 and 3 at its ends, respectively; 4 and 5, electrode feed-throughs each of which comprises a niobium tube and is extended through center holes of the end cap 2 or 3 and the end of the arc tube 1 and gas-tightly sealed with ceramic cement or the like. Electrodes 6 and 7 which are extended from the inner ends, respectively, of the feed-throughs 2 and 3 are tungsten coils containing an electron-emitting compound. Thermally protective layers 8 and 9 in the form of a tantalum foil or film cover the end caps 2 and 3 and the end portions of the arc tube 1, so that the temperature at the coolest points at the ends of the arc tube 1 can be raised. The arc tube 1 is filled with sodium amalgam 10 and xenon or a penning gas 11 consisting of neon and argon. The arc tube 1 is supported in an outer tube or bulb (not shown) which is evacuated.

It has been well known in the art that the lamp efficacy of the prior art arc tube of the type described above with reference to FIG. 1 can be attained only by increasing the wall load. However, the increase in the wall load results in a rise in wall temperature. Therefore, if an arc tube is made of polycrystalline alumina ceramic, the consumption of sodium is increased due to the reaction with the alumina arc tube 1. In addition, lower alumina oxides and metallic aluminum are vaporized from the outer wall surfaces of the arc tube and then deposited on the inner wall surfaces of the outer tube so that the life is shortened. As a consequence, in order to ensure the average life of 6000 to 9000 hours of the arc tube, which is fabricated with a commercially available aluminum ceramic tube, the wall load of the arc tube is designed in the range of 17 to 22 W/cm$^2$.

Figure 2:
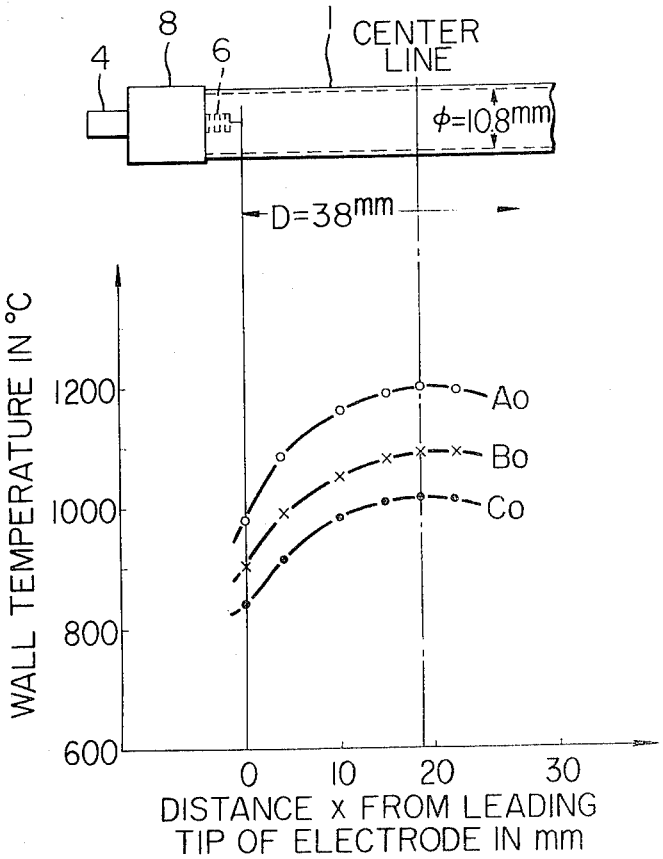
FIG. 2 PRIOR ART
FIG. 2 shows the axial wall temperature distribution thereof.

The arc tube of the type described (which was removed from its outer tube) was placed in an evacuated demountable apparatus and turned on to measure the wall temperature with a thermocouple (Pt-Pt.13% Rh). The arc tube was straight and had a rated lamp wattage of 250 W and the input (the wall load) was varied. The results are shown in FIG. 2 in which the wall temperature is plotted along the ordinate. In FIG. 2, curves $A_o$, $B_o$ and $c_o$ were obtained under the following conditions:

TABLE 1

| Curve | Average wall load W/cm² | Input to lamp W |
|---|---|---|
| $A_o$ | 26.8 | 345 |
| $B_o$ | 19.8 | 255 |
| $C_o$ | 17.1 | 220 |

Under conditions: Na-78 mol % amalgam
Ne-0.5% Ar- 25 Torr

From FIG. 2 the following conclusions can be drawn.

(1) The wall temperature at the midpoint of the arc tube rises with increase in wall load. With the wall load of 17 to 22 W/cm² (which range is considered optimum in the prior art), the wall temperature at the midpoint is 1020 to 1130° C. It should be noted that the wall temperature is that of the arc tube itself. To put into another way, if the arc tube is supported in the outer tube, the wall temperature would further rise by 30 to 50° K. The temperature rise is dependent upon the shape of the outer tube and is highest in the case of the tubular-shaped outer tube.

The chemical reaction between sodium and the alumina arc tube is dependent greatly upon the crystal growth of the alumina ceramic used. The above-described wall load range of 17 to 22 W/cm² which has been considered optimum in the prior art is determined in consideration of the variation in quality of alumina tubes from one lot to another. Therefore, if the qualities of alumina tubes are improved, the wall load can be, of course, increased. For instance, the inventors fabricated arc tubes from alumina tubes with highest qualities available. These arc tubes had an average life of about 6000 hours even with the wall load of about 27 W/cm² (about 1200° C. at the midpoint of the arc tube not supported by the outer tube). In view of the above, it is possible to determine the wall temperature at the midpoint of the arc tube between 1020 and 1200° C. (when the arc tube is not supported in the outer tube) at a rated lamp watts.

(2) The wall temperature drops with distance from the midpoint of the arc tube. The wall temperature drop is remarkable especially adjacent the electrodes and the wall temperature adjacent to the inner tips of the electrodes is about 82% of the wall temperature at the midpoint. The inventors measured the amount of sodium reacted with the alumina arc tube of a high color-rendition, high-pressure sodium lamp after the expiration of its life. The reaction is highest at the midpoint of the arc tube at which the wall temperature is highest and drops gradually toward the ends and is lowest at the ends.

DESCRIPTION OF THE PREFERRED EMBODIMENT

The inventors made extensive studies and experiments for the purpose of improving the lamp efficacy and found out that if the wall temperature distribution in the axial direction of the arc tube is well taken into consideration in design, the average wall load can be increased and consequently high-rendition, high-pressure sodium lamps with high lamp efficacies can be obtained as will be described in detail below.

Figure 3:
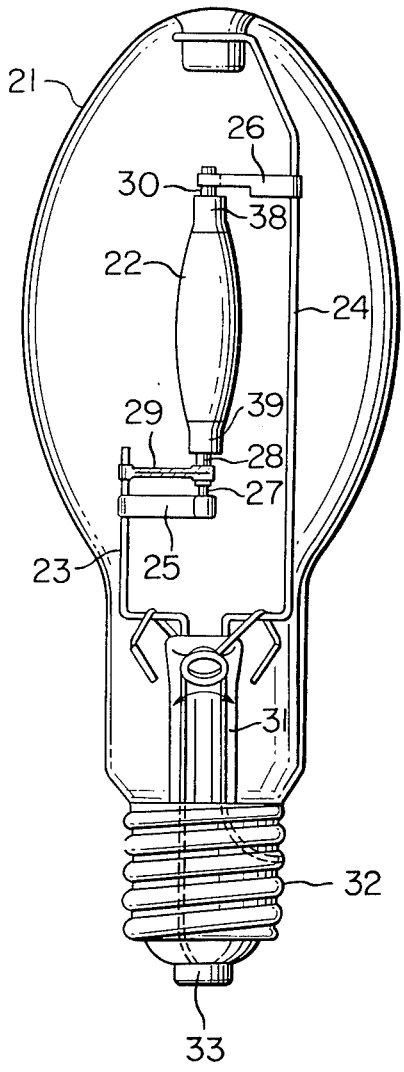
FIG. 3 is a view in elevation of a high-pressure sodium lamp embodying the present invention.

In FIG. 3 is shown an embodiment of the present invention. A high-pressure sodium lamp has an arc tube 22 mounted in an outer jacket 21 which is made of glass and is evacuated as with the conventional discharge lamp. The arc tube 22 is supported by supporting leads 23 and 24, lower and upper supports 25 and 26 and an insulating rod 27. One end of the lower support 25 is welded to the supporting lead 23 and the other end thereof supports one or the lower end of the insulating rod 27 the other or upper end of which is loosely fitted into a lower feed-through 28 electrically connected to the lead 23 through a horizontal lead wire 29. One end of the upper support 26 is welded to the supporting lead 24 while the other end thereof to an upper feed-through 30.

The supporting leads 23 and 24 are extended through a glass stem 31 and are connected to a shell 32 and a base contact 33, respectively.

Figure 4:
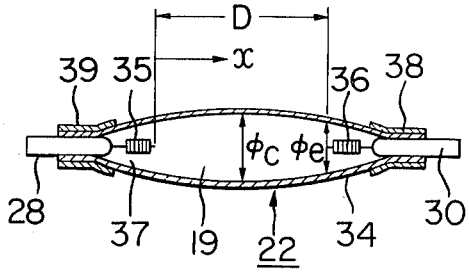
FIG. 4 is a longitudinal sectional view of an arc envelope thereof.

Referring next to FIG. 4, the construction of the arc tube 22 will be described in more detail. It comprises an alumina tube or envelope 34 and the feed-throughs or niobium tubes 28 and 30 fitted into the ends of the alumina tube 34 and air-tightly bonded thereto with ceramic cement or the like. The inner diameter of the alumina tube 34 is largest at the midpoint of the alumina tube 34 and is reduced in the vicinity of the ends. Electrodes, or tungsten coils, 35 and 36 are supported at their one ends by the leading or inner ends of the feed-throughs 28 and 30, respectively. The arc tube 22 is filled with sodium amalgam 37 and xenon or a penning gas consisting of neon and argon. Tantalum thermally protective layers 38 and 39 cover the end portions of the alumina tube 34.

Figure 5:
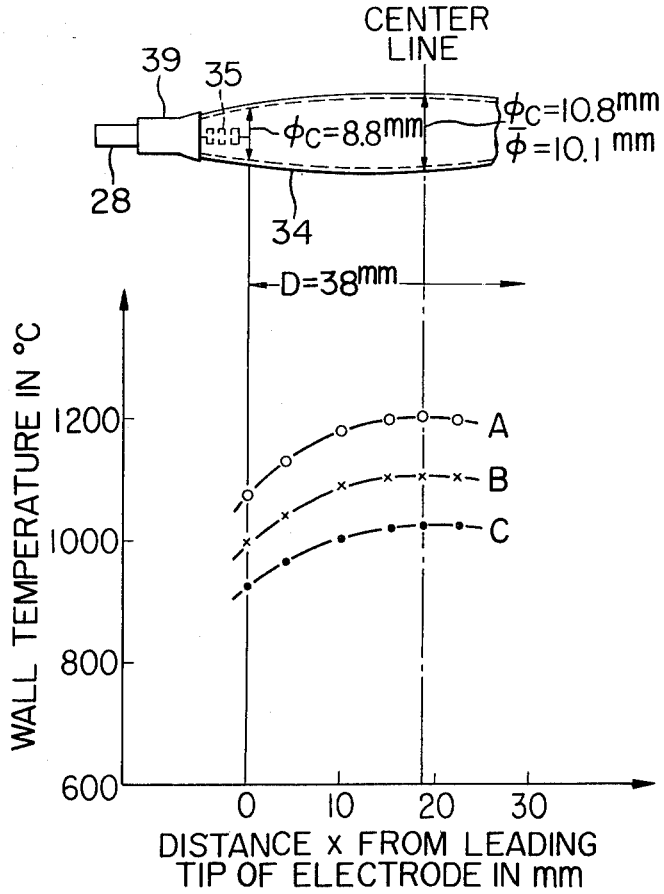
FIG. 5 is a view similar to FIG. 3, but illustrates the axial wall temperature distribution of the arc tube shown in FIG. 4.

Following the experimental procedure described previously, the wall temperature of the arc tube 22 (without an outer tube) is measured and the results are shown in FIG. 5. In FIG. 5, curves A, B and C were obtained under the following conditions:

TABLE 2

| Curve | Average wall load W/cm² | Input to lamp W |
|---|---|---|
| A | 28.7 | 345 |
| B | 21.2 | 255 |
| C | 18.3 | 220 |

Under conditions: Na-78 mol % amalgam
Ne-0.5% Ar- 25 Torr

The comparison with FIG. 2 shows the following novel effects and features.

(1) If the inner diameter at the midpoint of the arc tube is same as the distance between the electrodes and if the input is same, the wall temperature at the midpoint is almost equal to those of straight-tube lamps. However, the average wall load (the value obtained by dividing the total input to the arc tube by the area of the inner wall surface between the tips of the electrodes) is higher than those of straight-tube lamps. It follows, therefore, that when the arc tube comprising an ellipsoidal envelope embodying the present invention is used and even when the average wall load is increased, the midpoint wall temperature which mainly determines the amount of sodium with the arc tube can be maintained almost equal to those of the straight-tube lamps.

(2) Since the average wall temperature is higher, the wall temperatures at the ends of the arc tube are, of course, higher than those of straight-tube lamps, but are still low and about 90% of the midpoint wall temperature.

Based upon the above-described observed facts, the inventors fabricated high-pressure sodium lamps whose average wall load is higher than those of straight-tube lamps and whose midpoint wall temperature is almost equal to those of straight-tube lamps. The average life of these lamps was measured. The arc tubes with a designed midpoint wall temperature of 1020° to 1130° C.

have an average life of 6000 to 9000 hours. The arc tubes which were fabricated with high-quality alumina ceramic tubes and whose designed midpoint wall temperature was 1200° C. had an average life of about 6000 hours.

These results show that if the arc tube is ellipsoidal in shape, the average life is not adversely affected even when the wall temperatures at the ends of the arc tube become relatively higher; that is, about 90% of the midpoint wall temperature as compared with about 82% of the straight-tube lamp. The quantitative analysis shows that the amount of sodium reacted with the arc tube remains almost equal to that of the straight-tube lamp as long as the wall temperatures at or adjacent to the midpoint are almost same. In both the lamps of the present invention and the prior art, the amount of sodium reacted with the arc tube is very small at the ends of the arc tube so that the overall amount of sodium reacted with the arc tube remains almost equal to that of the straight-tube lamp.

Furthermore, the lamp efficacy is increased. That is, a high average wall load can be obtained.

Various lamps were fabricated which were different in the inner diameter $\phi_c$ (See FIG. 5) at the midpoint of the arc tube and the inner diameter $\phi_e$ (See FIG. 5) in a plane perpendicular to the axis of the electrode at the leading or inner tip of the electrode 35 (See FIG. 5); that is, the diameter of a circle of the intersection of the surface of the envelope 34 with said perpendicular plane. The inner diameter $\phi_e$ will be referred to as "the at-electrode inner diameter $\phi_e$" for brevity hereinafter in this specification. The lamp efficacy of these arc tubes were investigated. The lamp efficacy of an arc tube whose wall temperatures at the leading tips of the electrodes are higher than 85% of the midpoint wall temperature is higher by more than 6% over the conventional straight-tube lamp if the midpoint wall temperatures are same. If the wall temperatures at the leading tips of the electrodes are higher than the midpoint wall temperature by more than 88%, the lamp efficacy can be increased by more than 8%. It follows, therefore, that a maximum lamp efficacy can be attained by reducing the at-electrode inner diameter as much as possible as compared with the inner diameter at the midpoint of the arc tube. However, as disclosed in detail in Japanese Patent Application No. 129780/1980, the following condition must be satisfied:

$$\phi_e \geqq 0.6\phi_c$$

If $\phi_e < 0.6\phi_c$, there arises the problem that radiation at the midpoint shifts to blue as compared with the sodium radiation at the ends of the arc tube. After extensive studies and experiments, the inventors found out the fact that if $\phi_e \geqq 0.7\phi_c$, high color-rendition lamps can be obtained in which the sodium radiation is same in color at the midpoint and ends of the arc tube. However, the inventors further found out the fact that a small deviation from the above-described optimum range such as $0.7\phi_c > \phi_e \geqq 0.6\phi_c$ will not give rise to any serious problem in practice.

In addition to the above-described parameters, the vapor pressure of sodium when the lamp is turned on must be also taken into consideration in design. In the case of the conventional straight-tube lamp, the vapor pressure has been well known. For instance, in order to design a high-rendition, high-pressure sodium lamp which exhibits a color temperature of higher thatn 2300° K. and which can be used instead of an incandescent lamp, $E \geqq 37.7 - 2.05\phi_o$, where E is the average potential gradient obtained by dividing the lamp voltage by the distance between the electrodes, the unit being V/cm; and $\phi_o$ is the inner diameter in mm of the arc tube. The inventors prepared various arc tubes which were different in the midpoint diameter $\phi_c$ and the at-electrode inner diameter $\phi_e$ to investigate whether the above-described condition can be applied to the arc tube embodying the present invention. It was found out that the above-described condition can be equally applied to the arc tube embodying the present invention if, instead of the inner diameter $\phi_o$, the average inner diameter $\bar{\phi}$ is used which can be defined as $$\bar{\phi} = \int_0^D \phi(x)dc/D$$

where D is the distance between the electrodes; and x is the distance from the leading end of one of the electrodes (See FIG. 5).

It follows, therefore, that if $\phi_o$ and $\bar{\phi}$ are equal and the average potential gradients are also same (under the condition that both the arc tubes are filled with the same amount of sodium amalgam), both the arc tube of the present invention and the conventional arc tube exhibit the same color rendition.

In view of the above, in order to provide a high color-rendition, high-pressure sodium lamp which has an ellipsoidal arc tube, exhibits the lamp efficacy higher than 6% as compared with the conventional straight-tube lamp and has a long average life, it must satisfy the following design conditions:

$$T_e \geqq 0.85T_c \quad \text{(a)}$$

where $T_c$ is the midpoint wall temperature, and $T_e$ is the wall temperature adjacent to the leading tip of the electrode.

Both the wall temperatures $T_c$ and $T_e$ are measured without the use of an outer tube or bulb.

$$\phi_e \geqq 0.6\phi_c \quad \text{(b)}$$

This condition must be satisfied so that the color rendition remains same in the axial direction of the arc tube.

$$E \geqq 37.7 - 2.05\bar{\phi} \quad \text{(c)}$$

This condition must be satisfied so that the sodium lamp embodying the present invention can be used instead of an incandescent lamp with a color temperature of about 2300° K.

In the TABLE below are summarized the specifications and characteristics of the high-pressure sodium lamps embodying the present invention.

TABLE 3

| | specifications | | | | | | characteristics | | | | |
|---|---|---|---|---|---|---|---|---|---|---|---|
| lamp watts | D | $\phi_c$ | $\phi_e$ | $\bar{\phi}$ | rare gas | thermally protective layers | lamp voltage (V) | lamp input (W) | efficacy (lm/W) | $T_e/T_c$ | Ave. life (hr) |
| 50W | 12 | 6.0 | 5.0 | ~5.6 | Ne—0.5% Ar | o | 53 | 54 | 39 | 980/1070 | 8,000 |
| | 10 | 5.2 | 4.0 | ~4.6 | Xe | x | 52 | 51 | 41 | 1050/1130 | 7,000 |
| 150W | 28 | 9.0 | 7.5 | ~8.5 | Ne—0.5% Ar | o | 104 | 153 | 57 | 950/1050 | 9,000 |
| | 26 | 7.5 | 5.7 | ~6.8 | Ne—0.5% Ar | x | 103 | 150 | 59 | 1070/1150 | 7,000 |
| 250W | 40 | 11.6 | 9.8 | ~11.0 | Ne—0.5% Ar | o | 108 | 252 | 58 | 900/1040 | 12,000 |
| | 38 | 10.8 | 8.8 | ~10.1 | Ne—0.5% Ar | x | 109 | 255 | 60 | 1000/1110 | 9,000 |
| | 36 | 9.7 | 7.7 | ~9.0 | Xe | x | 115 | 248 | 62 | 1150/1160 | 7,500 |
| 400W | 50 | 13.0 | 10.5 | ~12.2 | Ne—0.5% Ar | o | 118 | 406 | 63 | 970/1070 | 12,000 |
| | 48 | 12.0 | 9.0 | ~11.0 | Ne—0.5% Ar | x | 123 | 400 | 66 | 1020/1130 | 9,000 |

Remarks:

(1) o: provided
x: not provided (2) The lamps were designed to exhibit color temperatures of about 2500° K.

(3) Even if the midpoint wall temperatures are same, the lamp life is shorted with increase in lamp watts. The reason is that since the distance D between the electrodes is shortened, the lower the lamp watts, the more pronounced sputtering becomes.

(4) Relationships between the midpoint wall temperature and wall load are different depending upon the lamp watts because the lower the lamp watts, the more pronounced the influence at the ends of the arc tube becomes.

Sodium amalgam consists of 78 mol % of sodium and Xe or (Ne-0.5%Ar) is 20 to 25 torr. One of the features of the present invention resides in the fact that since the arc tube is reduced in inner diameter with distance from the midpoint thereof, it is not necessary to provide the thermally protective layers 38 and 39 (See FIG. 4) so that the lamp efficacy can be increased further by 1 to 2% (because the radiation is not shielded by the protective layers) and the fabrication steps can be reduced in number.

From the above Table 3 it is seen that, as compared with the prior art lamps with a straight arc tube, the present invention can improve the lamp efficacy by 7 to 16% and ensure the lamp life from 6000 to 9000 hours.

What is claimed is:

1. A high-pressure sodium lamp comprising:

(A) an arc envelope made of alumina, fitted air-tight at both ends thereof with electrodes and associated parts thereof, and shaped so that the inner and outer diameters thereof in the vicinity of both ends thereof are reduced gradually relative to the inner diameter of the midpoint thereof; and (B) when said arc envelope is turned on without being supported in an outer envelope, the following conditions are satisfied:

$$T_e \leqq 0.85 T_c \text{ and } 1020° \text{ C.} \leqq T_c \leqq 1200° \text{ C.}$$

where $T_e$ is the wall temperatures adjacent to the leading tips of the electrodes, and $T_c$ is the wall temperature at said midpoint.

2. A high-pressure sodium lamp as set forth in claim 1 further characterized in that the following condition is satisfied:

$$\phi_e \geqq 0.6\phi_c$$

where $\phi_e$ is the inner diameter of the intersection of the wall of said arc envelope with a plane perpendicular to the axis of each of the electrodes at the leading or inner tip thereof, and $\phi_c$ is the inner diameter at said midpoint.

3. A high-pressure sodium lamp as set forth in claim 1 further characterized in that the following condition is satisfied:

$$E \geqq 37.7 = (\sim) 2.05\bar{\phi}$$

where E is the average potential gradient (V/cm) of said arc envelope and $\bar{\phi}$ is the average inner diameter (mm) of said arc envelope between said electrodes thereof.

* * * * *